United States Patent [19]

Sauder

[11] Patent Number: 4,696,085

[45] Date of Patent: Sep. 29, 1987

[54] APPARATUS FOR PRESSING TUBULAR PARTS

[75] Inventor: Karl Sauder, Zurich, Switzerland

[73] Assignee: Firma Compat Aktiengesellschaft, Fürstentum, Liechtenstein

[21] Appl. No.: 882,432

[22] PCT Filed: Feb. 1, 1983

[86] PCT No.: PCT/EP83/00024

§ 371 Date: Oct. 4, 1983

§ 102(e) Date: Oct. 4, 1983

[87] PCT Pub. No.: WO83/02737

PCT Pub. Date: Aug. 18, 1983

Related U.S. Application Data

[63] Continuation of Ser. No. 552,138, Oct. 4, 1983, abandoned.

[30] Foreign Application Priority Data

Feb. 4, 1982 [AT] Austria ..... 424/82

[51] Int. Cl.[4] ..... B23P 19/04

[52] U.S. Cl. ..... 29/237; 72/402

[56] References Cited

U.S. PATENT DOCUMENTS

| | | | |
|---|---|---|---|
| 2,999,405 | 9/1961 | Ewart | 29/237 X |
| 3,879,834 | 4/1975 | Johnson | 29/516 X |
| 3,972,112 | 8/1976 | O'Sickey et al. | 29/237 X |
| 3,977,065 | 8/1976 | Johnson | 29/237 |
| 4,034,593 | 7/1977 | Patel | 29/237 X |
| 4,071,936 | 2/1978 | Smith | 29/237 X |
| 4,314,706 | 2/1982 | Pruden | 279/4 X |
| 4,331,019 | 5/1982 | Smith | 29/237 X |
| 4,432,559 | 2/1984 | Rasmussen | 279/4 |

FOREIGN PATENT DOCUMENTS

| | | | |
|---|---|---|---|
| 2612345 | 11/1976 | Fed. Rep. of Germany | 29/237 |
| 2707993 | 8/1977 | Fed. Rep. of Germany | 29/237 |
| 2613240 | 10/1977 | Fed. Rep. of Germany | 29/237 |
| 1548265 | 12/1968 | France | 29/237 |
| 2229479 | 12/1974 | France | 29/237 |
| 2033281 | 5/1980 | United Kingdom | 29/237 |

*Primary Examiner*—Gil Weidenfeld
*Assistant Examiner*—Glenn L. Webb
*Attorney, Agent, or Firm*—Toren, McGeady and Goldberg

[57] ABSTRACT

An apparatus for pressing tubular parts, more particularly for pressing or forcing pipe-unions onto pipes, sleeves or hoses. The apparatus includes a plurality of spring loaded, radially adjustable jaws and an annular piston in operative communication with the jaws. The piston can move hydraulically towards the jaws and can be returned hydraulically to its neutral position. The effective area of the piston, by means of which it is returned to its neutral position, amounts to only a fraction of the piston-area which advances the piston. The end of the piston remote from the jaws engages in an annular hydraulic cylinder, the entire cross-section of the piston which is largest at this end, forming the effective piston-area which advances the piston.

7 Claims, 3 Drawing Figures

APPARATUS FOR PRESSING TUBULAR PARTS

This is a continuation of application Ser. No. 552,138, filed Oct. 4, 1983, now abandoned.

The invention relates to an apparatus for pressing tubular parts, more particularly for pressing and nipping pipe-unions onto pipes, sleeves or hoses, the said apparatus consisting of a plurality of spring-loaded jaws adapted to be adjusted radially, and of a piston of annular cross-section which acts upon the said jaws, the interior of the said piston being enlarged conically at the end facing the jaws, the radially external boundary surfaces thereof bearing, with a corresponding angle of inclination, upon the said conical enlargement, and the said piston being adapted to move hydraulically towards the said jaws and to be returned hydraulically to its neutral position.

A few examples of embodiment of such apparatus are already known. More particularly, an apparatus of this kind is used for pressing pipe-unions onto the ends of hydraulic hoses. Pipe-unions of this kind are generally in the form of two tubular sections arranged coaxially of each other, joined together at one end carrying the parts of the union, for example threaded sections. An annular gap remains between the two tubular parts, into which the end of the hose is inserted. The parts of the pipe-union thus assembled are then inserted between the jaws of the apparatus and pressure is applied radially, the end of the hose being thus firmly clamped between the two tubular sections.

In one known device of this kind, several jaws are arranged around an axis and are placed within a pressing element comprising a conically tapering internal surface. A cylindrical hydraulic piston is provided in order to shift the pressing element against the jaws. This movement, and the conical configuration of the conical surface bearing against each other, causes the jaws to move radially towards each other, and the hose-connection placed between the said jaws is thus compressed. Also provided are measuring means which indicate whether the desired final outside diameter has been reached. To this end, the measuring means must be observed by the operator, in order that the drive to the apparatus may be shut off at this moment. In an apparatus of this kind, the hydraulic cylinders must be relatively large in order to achieve the necessary pressure. If only a lower operating pressure is available, this raises complex design problems, since the apparatus becomes bulky.

Attempts have already been made to use a largearea piston in axial arrangement in relation to the axis of the jaws. With a design of this kind however, the apparatus is accesible only from one side, which means that only terminal pipe-unions can be fitted. For example, a sleeve-joint for a hoseline cannot be fitted with an arrangement of this kind. Furthermore, this design requires a plurality of spring-loaded spindles for the purpose of returning the jaw-actuating elements to the neutral position. Here again, this is a costly and complex design. If these spindles are not equipped with springs, the actuating elements and spring-loaded jaws can be returned only by their own weight. This substantial reduces the operating speed and leads to breakdowns during operation.

In the case of another apparatus, in which the jaws are actuated by direct radial action of a pressure-medium, problems arise, since the necessary pressure can by no means be obtained. This means that pressure must be built up by the pressure-medium and this can be accomplished only by designing an oversized apparatus.

In the case of another known apparatus, a piston is mounted displaceably in a cylindrical housing having a stop-shoulder, the said piston being also equipped with an outwardly directed stop-shoulder. A cylinder-chamber is provided between the outer surface of the piston, the inner surface of the cylinder, and the two boundary surfaces, facing each other, of the said stop-shoulders, and this chamber can be acted upon hydraulically. Again, an arrangement of this kind produces space problems and apparatus with correspondingly large dimensions, since almost the same piston-cylinder unit must be provided laterally outside the actuating parts, in the form of pistons, for the jaws. Furthermore, in the case of a known unit of this type, it must be regarded as a disadvantage that a plurality of springs must be provided to return the actuating element, i.e. the piston, to its neutral position after a pressing operation. On the one hand, this involves additional material and space and the design is therefore costly. On the other had, this additional spring-force must be overcome at each pressing operation.

Also known is a pressing apparatus which is actuated by a double-acting piston, in which the device is moved both forwards and backwards by hydraulic power. Use is made of an inner and an outer cylindrical element, two annular chambers being formed between these two elements, the inner element acting as a hydraulic cylinder and the outer element as a hydraulic piston. In this case, in order to be able to build up adequate pressure for the pressing operation, a correspondingly large piston-area is necessary. This requires a correspondingly large, inwardly projecting shoulder, in order to achieve the necessary piston-area. However, since this piston must also form the wall of a cylinder, this leads to large dimensions, at least in the transition-area between this outer wall and the inwardly projecting shoulder. Furthermore, the cylinder must be relatively thick, since the projecting shoulder must itself absorb the enormous forces. There is no way of using an opposing wall to provide support, since the shoulder projects freely.

It is therefore the purpose of the invention to provide an apparatus of the type outlined at the beginning hereof which is of simple design and takes up little space.

According to the invention, this purpose is achieved in that the effective piston-area, which returns the double-acting piston to its neutral position, is only a fraction of the piston-area which advances the said piston; in that the end of the piston remote from the jaws engages in an annular hydraulic cylinder; and in that the effective piston-area, which advances the said piston, is formed at the free end thereof remote from the jaws and runs parallel with the base of the annular cylinder, the said piston having its hargest cross-section at the end constituting the effective piston-area which advances the piston.

According to the present invention, a substantial advantage is obtained in that the effective piston-area for the hydraulic return of the piston is only a fraction of the piston-area used to advance the said piston. This results in a matching of the necessary forces, since the pressing operation requires a considerably larger piston-area than the return of the piston to its neutral position.

Substantial design improvements are achieved, in that the piston runs in an annular hydraulic cylinder and in that the effective piston-area required to advance the piston is formed at the free end thereof remote from the jaws. The base of the cylinder is thus carried in practice by two sleeves, i.e. by the annular cylinder-surface, thus making it possible to use smaller inner and outer cylinder-rings. This also has a particularly favourable effect upon the cross-section of the piston, since almost the entire cross-section of the annular piston may be used in applying the force, and this can only be if this effective piston-area is formed by the end of the piston. Since returning the piston requires only a very small piston-area, the stepping down of the piston in the corresponding area scarcely signifies any weakening of the cross-section. All of the forces can thus be transfered through the piston in the axial direction, without any danger of shearing-off or bending the projecting parts.

It is also to be regarded as an essential advantage of such an arrangement that all guiding surfaces between the piston and the cylinder are covered from the outside and cannot therefore be damaged mechanically.

Additional characteristics and additional advantages of the invention are explained hereinafter in greater detail in conjunction with the drawings attached hereto, wherein.

Figure 1:
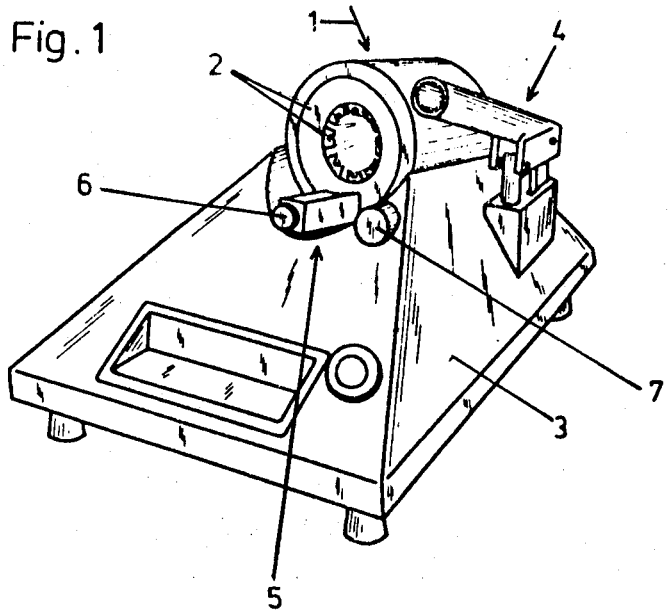
FIG. 1 is a perspective view of the apparatus according to the invention.

The apparatus illustrated in FIG. 1 consists essentially of a cylinder-body 1 accommodating jaws 2 and the actuating elements thereof, and of a housing 3 carrying the said cylinder-body. The said housing contains a hydraulic valve which regulates the supply of pressure-medium to the actuating element. The necessary pressure may be obtained from a hand-pump 4 or from appropriate external connections. Also provided is an adjusting device 5 having an adjusting knob 6 and a scale. As will be explained in detail hereinafter, this devices makes it possible to adjust the desired final diameter of the pressed part. Also provided is an actuating grip 7 whereby the hydraulic valve may be changed-over. As may be gathered from FIG. 1, the apparatus according to the invention may be made very small, but compact. An apparatus of this kind is therefore suitable for use as a stationary unit or for individual use in any operation, at any location and at any point. Instead of an outside connection, and in addition to the hand-pump, an electrically operated pump may also be accommodated in housing 3, for the purpose of building up the necessary pressure.

Figure 2:
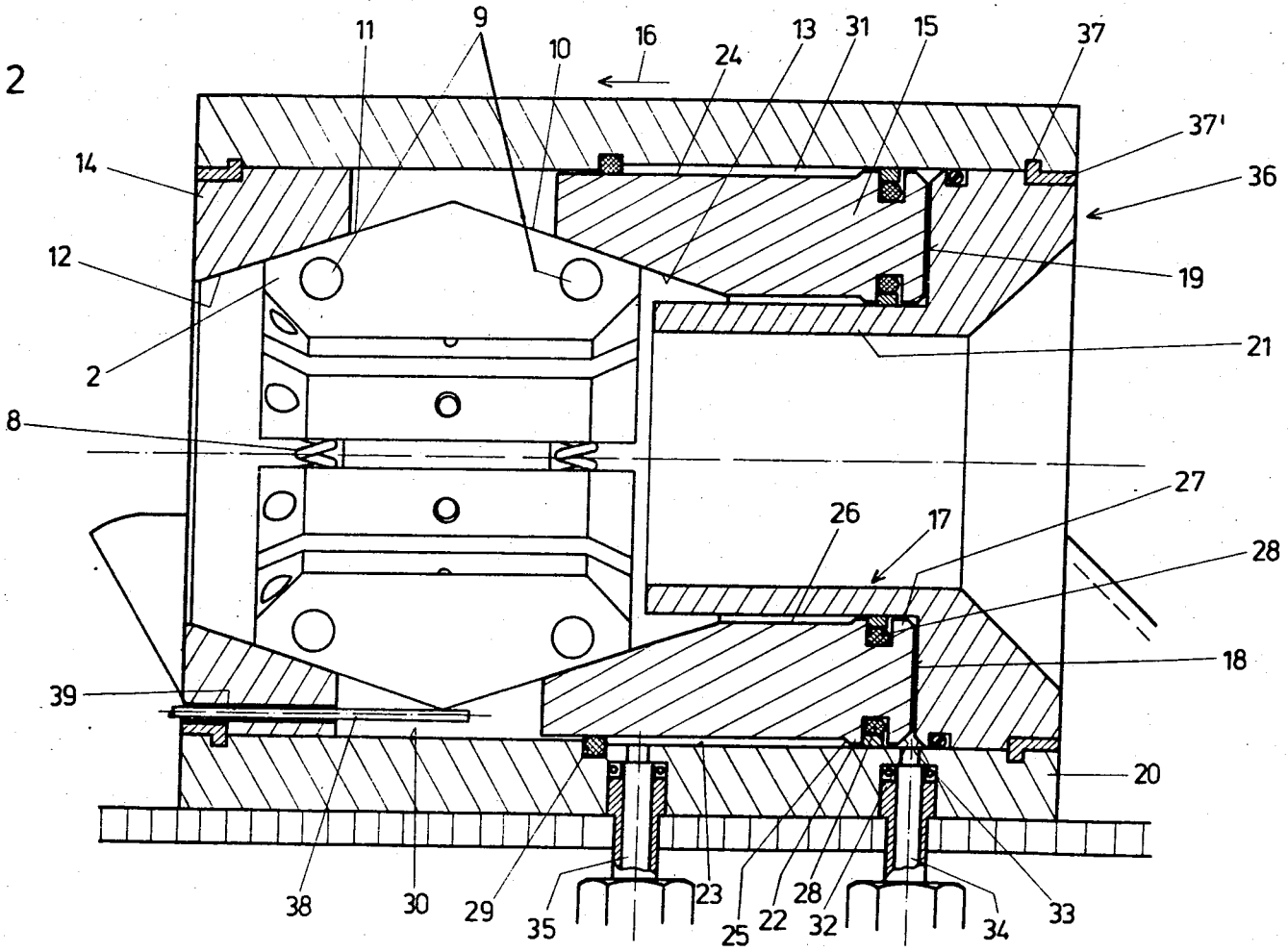
FIG. 2 is a section through the pressing apparatus.

The structural design of the apparatus according to the invention may be gathered substantially from the longitudinal section in FIG. 2. Several jaws are provided of an approximately segmental shape arranged side by side. Depending upon the desired range of final diameters, various inserts may be secured to internal surfaces of the jaws. These jaws 2 are adjustable in the radial direction and are spring-loaded in relation to each other, springs 8 being inserted between two jaws into corresponding holes 9. The exteriors of the jaws are in the form of conical surfaces 10, 11 tapering towards both ends. Conical surface 11 rests upon a conical expansion 12 of a conical ring 14, while conical surface 10 rests upon a conical expansion 13 of piston 15. The latter serves as the actuating element for jaws 2. Thus when piston 15 is displaced in the direction of arrow 16, jaws 2 are pushed towards each other radially and also move slightly in an axial direction, since they execute a uniform relative movement in relation both to the piston and to the conical ring.

Piston 15 is of annular design and, in the example of embodiment shown, is inserted into an annular hydraulic cylinder. Effective piston-area 18, which advances the piston, is located at the free end of piston 15 remote from jaws 2 and runs parallel with base 19 of annular hydraulic cylinder 17. This makes it possible to utilize the entire cross-sectional area of the said piston, and there is no need to provide an additional stop-web, or a correspondingly large stop-shoulder, to form a piston-area. Effective piston-area 18 is thus located at the largest cross-sectional area of the piston, and the structural dimensions thereof can thus be kept very small.

Annular hydraulic cylinder 17 may also be of a very simple design, being formed by an external cylinder-sleeve 20 and a coaxially inserted tubular part 21 which is integral with cylinder-base 19. This permits very simple production, using turned parts.

At the end facing piston-area 18, the piston comprises a peripheral shoulder 22, the outside diameter thereof being larger than the remainder of the piston. Outer surface 23 of hydraulic cylinder 17 is designed, at least along the path of travel of shoulder 22, with an enlarged inside diameter corresponding to the outside diameter of shoulder 22. This provides an annular cylinder-chamber which is enclosed, on the one hand by inner surface 23 of external cylinder sleeve 20 and, on the other hand, by outer surface 24 of the piston. The surface of shoulder 22 remote from piston-area 18, forms a piston area 25 which is only a fraction of piston-area 18. This very simple arrangement according to the invention not only permits hydraulic pressing to be carried out, but also permits piston 15 to be returned hydraulically to its neutral position.

It is quite possible to provide, on inner surface 26 of piston 15 also, an inwardly projecting shoulder 27 in order to obtain a relatively short guide-surface for piston 15 within hydraulic cylinder 17. Additional sealing rings and other sealing elements are provided in the vicinity of shoulders 22 and 27. Another sealing rings is provided at the transition between inner surface 23, of larger diameter and inner surface 30, of smaller diameter. This sealing ring 29 provides a seal when piston 15 is returned to its neutral position. The cylinder chamber thus formed causes no weakening of cylinder sleeve 20 of or piston 15, but the said chamber is quite capable of ensuring correct return of the piston.

Arranged at the outer edge of base 19 of hydraulic cylinder 17, and possibly also at the outer edge of piston-area 18, are groove-like depressions or chamfers which, when piston 15 is in its neutral position, form jointly a peripheral annular channel. Opening into this channel is feed-line 34 for the pressure-medium, so that, when piston-area 18 is lying directly upon base 19, the pressure medium can enter, causing piston 15 to move in the direction of arrow 16.

Pressure-medium feed-line 35, which returns the piston, opens into annular cylinder-chamber 31 in the vicinity of sealing ring 29 on the cylinder side. Thus, even when piston 15 is fully extended a regular supply of pressure-medium is available.

One particular advantage from the design point of view is provided by the configuration according to the invention whereby no non-standard threaded joints are necessary. With threaded joints, the outer cylinder sleeve would have to have a considerably larger cross-section and the other parts would have to be larger accordingly. The configuration according to the invention makes it possible to connect component 36, comprising conical ring 14, tubular part 21 and base 19, without any threaded fasteners, grooves 37 being provided in the cylinder-sleeve, in which lock-rings 37' engage. These lock-rings are of L-shaped cross-section, with one leg bearing against the inner wall of cylinder-sleeve 20 and the other leg engaging in groove 37 therein. In order to be able to fit them into grooves 37, the said lock-rings are divided one or more times, as seen in their peripheral direction. If only one dividing location is provided, the parting surfaces of the lock-rings run at an acute angle to a radial plane of the said lock-rings, in order to facilitate insertion. Provision is furthermore made for the outer edge-areas of component 36 and conical ring 14 to be stepped, preferably over a length corresponding to the leg of the lock-ring bearing against the cylinder-sleeve, by an amount equal to the thickness of the said leg.

In the final condition, therefore, the two legs of lock-ring 37' are clamped between cylinder-sleeve 20, conical ring 14, and component 36. Under load, therefore, only shear-forces can arise, but no bending forces, as would be the case, for example, if a Seeger ring were to be used. Furthermore, a design of this kind provides a flat joint between all parts to be connected together and the loading limits are also very high. It is to be understood that an assembly of this kind, with lock-rings 37' according to the invention, is possible only if the components to be locked (conical ring 14 and component 36) can first be pushed sufficiently far into a cylinder-sleeve 20 to allow the said lock-ring to be entered into groove 37. Thereafter, the corresponding component is drawn out again until it bears against lock-ring 37'. This arrangement provides a joint which can carry a far greater load that would be possible with single screws. The resulting design has very small dimensions.

In the case of the present invention, furthermore, an adjustable switch-means, for switching-over a hydraulic valve, engages along the path of travel of piston 15. This makes it possible to change the valve over as a function of the extent to which jaws 2 are closed and thus in an accurately calculatable location of piston 15, thus allowing the apparatus to operate automatically. Thus piston-area 18 is acted upon up to the required pressing diameter, whereupon, after a previously adjustable amount of travel of the piston, the hydraulic valve is changed-over. Annular space 31 is then acted upon, causing the said piston to return to its neutral position.

Figure 3:
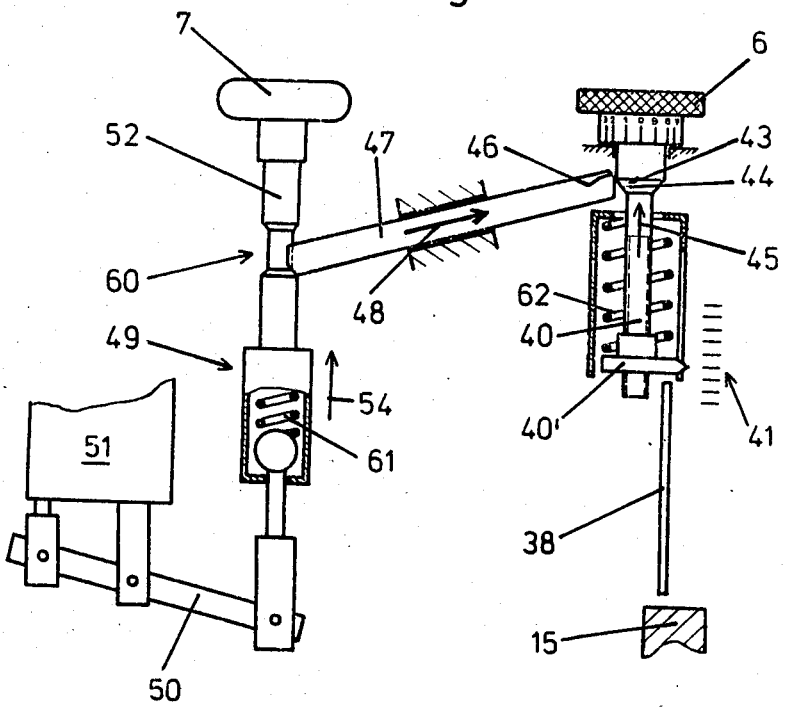
FIG. 3 is a diagrammatical representation of an adjustable device for changing-over a hydraulic valve as soon as a specific compression-diameter has been reached.

According to one particular example of embodiment, a control-rod 38 engages in the displacement range of piston 15, the said rod being adapted to be brought into operative connection with a stop 40', the distance between the said stop amd the end of the piston adjoining the jaws being adjustable. The design of this arrangement is simple, in that the said control-rod 38 is guided displaceably in a passage 39 in stationary conical ring 14. The change-over may be effected by mechanical transfer or by electrical switch-means. FIG. 3 shows a simple design. An adjusting knob 6, arranged upon a threaded shaft 40, allows stop 40' for control-rod 38 to be adjusted axially, so that, depending upon the final diameter desired, piston 15 strikes sooner or later the free end of the said control-rod and thus displaces stop 40'. It is also possible to provide a scale 41, with a suitable indicating element, so that the adjustment may be made visually from the outside. In this connection it is also desirable to provide fine adjustment which can be controlled as a function of the pitch of threaded shaft 40, in such a manner that, with an appropriate pitch, one revolution of the adjusting knob varies the pressing diameter by 1 mm.

A mechanical transfer of this change-over may be seen in FIG. 3. Movement of control-rod 38 causes a control-element 43 having a sloping run-up surface 44 to move in the direction of arrow 45 when the free end of piston 15 strikes. A chamfer 46 on an actuating rod 47 allows the latter to move in the direction of arrow 48. Actuating rod 47 is in operative connection with grip 7 secured to connecting rod 49. The latter extends to a lever 50 which causes hydraulic valve 51 to change-over. Actuating rod 47 engages in a recess 60 in bolt 52 on connecting rod 49, thus locking the said connecting rod in a position in which hydraulic valve 51 is set to the position which causes piston 15 to advance. After actuating rod 47 has been suitably returned in the direction of arrow 48, bolt 52 is released, so that lever 50, and thus connecting rod 49 also, are moved in the direction of arrow 54 by hydraulic valve 51, which is spring-loaded if necessary, and/or a spring 61.

As soon as actuating grip 7 is again moved in a direction opposite to that of arrow 54, either by manual pressure or by a magnet for example, actuating rod 47 can return to the position shown in FIG. 3, so that connecting rod 49 and bolt 52 are again locked. As a result of the action of spring 62, threaded shaft 40, and therefore stop 40', are also returned to the position shown in FIG. 3. This locks actuating rod 47 again. It is to be understood that control-rod 38 could also be spring-loaded, in such a manner as to bear against stop 40' in its neutral position.

One special advantage of the configuration according to the invention is the relatively short structural length of the apparatus, achieved by the special configuration of the double-acting piston. This eliminates the additional length produced by springs designed to return the piston. Since, according to the invention, the piston can quite simply be returned hydraulically, these additional structural parts may be dispensed with.

Instead of the arrangement of an annular cylinder, it would be conceivable to omit internal tubular part 21 of component 36, in which case a corresponding tubular part 21 could be permanently connected to piston 15, or could be made integral therewith. Such an extension of the piston would then have to project beyond base 19 of component 36 in the axial direction of the piston, since in a design of this kind, the tubular part 21, constituting a part of piston 15, would have to form the inner wall of the cylinder. It would then be necessary to provide an appropriate seal between the remainder of component 36 and tubular part 21 connected to, or integral with, the said piston. However, the configuration described hereinbefore is substantially more satisfactory since all of the specially machined (? processed) parts of the apparatus are covered and are therefore protected against damage.

Another special advantage of the apparatus according to the invention is that piston 15 is relatively easy to move as long as no pressure is being applied to a pipeunion, the reason for this being quite simply that no particular counter-forces are present. This has made it possible to fit an air-tight seal to the storage tank for the pressure-medium which will usually be oil, thus allowing pressure to be built-up within the said tank. It is sufficient, in this connection, to introduce compressed air into the free space in the tank, so that the pressure-medium itself is pre-loaded. This makes it possible, without operating any pump, to feed the pressure-medium through feed-line 34 entirely by the pressure built up in the storage tank, so that piston 15 is advanced in rapid travel to the position in which it comes to a stop at the part to be pressed. This accelerates the operating cycle substantially and no additional means are required to reduce piston-travel according to the size of the parts to be pressed. This rapid advance, made possible only by the ease of movement of the design according to the invention, thus eliminates the need for additional means for limiting the return movement of the piston.

It may be gathered from the cross-section FIG. 2 that the apparatus according to the invention is almost trouble-free and thus also maintenance-free. Any parts in danger of being damaged are either completely covered or are not accessible from the outside as the parts to be pressed are inserted. This also makes the apparatus extremely simple to operate. The design is simple and can be made relatively small, in spite of the high pressures attainable. As a result of this, the apparatus is very light and is thus easily transportable. The simple design is also obviously an inexpensive design.

I claim:

1. An apparatus for pressing tubular parts onto pipes, sleeves or hoses, comprising an external cylinder sleeve and a coaxially inserted tubular part forming an annular cylinder having a base, a plurality of spring-loaded radially adjustable clamping jaws and an annular piston which acts upon said jaws, the interior of said piston enlarged conically at the ends of said jaws, the radially outer boundary surfaces thereof having a corresponding angle of inclination and bearing upon said conical enlargement, and said piston movable hydraulically toward said jaws and returnable hydraulically to its neutral postion, wherein the effective piston area which is acted upon to return the double-acting piston to its neutral position has a size which is only a fraction of the piston area facing away from said jaws and extending parallel to said base which piston area is acted upon to advance said piston, and wherein said piston has its largest cross-sectional area at said end constituting the effective piston area which is acted upon to advance said piston, the end of said piston remote from said jaws engaging in said annular cylinder, wherein said external cylinder sleeve has a free end and extends axially from said cylinder to said free end, a conical ring inserted from said cylinder to said free end, a conical ring inserted permanently coaxially with said piston at said free end of said external cylinder sleeve facing away from said annular cylinder, the inner surface of said conical ring widening conically toward said piston and the outer surfaces of said jaws narrowing conically toward both ends in axial direction, wherein said conical ring and the component formed by said tubular part and said base of said cylinder are fixed to said external cylinder sleeve at both ends thereof by means of lock rings which engage in grooves defined in said external cylinder sleeve, wherein said base of said cylinder is formed integrally with said inserted tubular part, wherein said lock rings are of L-shaped cross-section, one of the legs bearing against the inner wall of said cylinder sleeve and the other leg engaging said groove, and said lock rings are divided at least once in the peripheral direction, the dividing surfaces of said rings running at an acute angle to a radial plane of said lock rings.

2. An apparatus according to claim 1, wherein the end of said piston remote from said jaws has on its external surface a peripheral shoulder of larger diameter, and the external surface of said cylinder has along the path of travel of said shoulder an inside diameter enlarged to match the outside diameter of said shoulder.

3. An apparatus according to claim 2, wherein the surface of said shoulder remote from the effective piston area which acts to advance said piston forms the effective piston area which acts to return said piston, an annular cylinder chamber formed by said outer surface of said piston, the inner surface of said external sleeve, said effective piston area for returning said piston, and the end face of the enlarged area having the larger diameter.

4. An apparatus according to claim 1, wherein at the outer edge of said cylinder base and at the outer edge area of said piston area which acts to advance said piston, groove-like chambers are provided which, when the piston is in its neutral position, jointly form a peripheral annular channel, the feed line for the pressure medium opening out in the vicinity of said annular channel.

5. An apparatus according to claim 1, wherein said component and said conical ring are stepped at the outer edge areas over a length corresponding to the leg of the lock ring bearing against said cylinder sleeve by an amount equal to the thickness of this leg.

6. An apparatus according to claim 1, wherein an adjustable switch means engages in the path of travel of said piston for switching an hydraulic valve.

7. An apparatus according to claim 1, wherein hydraulic fluid is aupplied from a storage tank, said storage tank closed off air-tight and connectible to a compressed-air line.

* * * * *